US010155135B2

(12) United States Patent
Aoyama

(10) Patent No.: US 10,155,135 B2
(45) Date of Patent: Dec. 18, 2018

(54) GOLF BALL AERODYNAMIC CONFIGURATION

(71) Applicant: Acushnet Company, Fairhaven, MA (US)

(72) Inventor: Steven Aoyama, Marion, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 15/377,031

(22) Filed: Dec. 13, 2016

(65) Prior Publication Data

US 2018/0161630 A1 Jun. 14, 2018

(51) Int. Cl.
*A63B 37/00* (2006.01)

(52) U.S. Cl.
CPC ..... *A63B 37/0006* (2013.01); *A63B 37/0021* (2013.01); *A63B 37/0074* (2013.01)

(58) Field of Classification Search
CPC ..... A63B 37/0006; A63B 37/0021; A63B 37/0074
See application file for complete search history.

(56) References Cited

U.S. PATENT DOCUMENTS 5,060,953 A 10/1991 Bunger et al.
5,482,287 A 1/1996 Nesbitt et al.
6,200,232 B1 * 3/2001 Kasashima ..... A63B 37/0004 473/379
6,435,988 B2 8/2002 Maehara et al.
6,682,442 B2 * 1/2004 Winfield ..... A63B 37/0004 473/378
6,705,959 B2 * 3/2004 Morgan ..... A63B 37/0004 473/383
6,719,647 B2 4/2004 Sajima
6,761,647 B2 7/2004 Kasashima
7,278,932 B2 10/2007 Kasashima et al.
7,520,824 B2 4/2009 Kasashima
2010/0190583 A1 * 7/2010 Aoyama ..... A63B 37/0004 473/381
2010/0240473 A1 * 9/2010 Aoyama ..... A63B 37/0004 473/384
2010/0261551 A1 10/2010 Felker et al.
2011/0021292 A1 1/2011 Madson et al.
2011/0165968 A1 7/2011 Madson et al.

* cited by examiner

*Primary Examiner* — John E Simms, Jr.
(74) *Attorney, Agent, or Firm* — Kristin D. Wheeler

(57) ABSTRACT

The present invention concerns golf balls having a modified aerodynamic configuration and a method for creating a modified aerodynamic configuration that improves dimple coverage, interdigitation, and non-alignment in golf ball dimple patterns by rotating the repeating area elements about pre-determined center points, with further optional steps of expanding or contracting the elemental arrangements about pre-determined center points, enlarging or reducing the sizes of dimples, and adding extra dimples to occupy land areas created by the previous steps. The resulting modified aerodynamic configuration with a rotated element has increased dimple coverage, greater interdigitation and improved non-alignment.

9 Claims, 15 Drawing Sheets

GOLF BALL AERODYNAMIC CONFIGURATION

FIELD OF THE INVENTION

The present invention relates to golf balls, and more particularly, to golf balls that have rotation of repeating elements in their dimple patterns resulting in improved coverage, interdigitation and non-alignment.

BACKGROUND OF THE INVENTION

The flight of a golf ball is determined by many factors. The majority of the properties that determine flight are outside of the control of the golfer. While a golfer can control the speed, the launch angle, and the spin rate of a golf ball by hitting the ball with a particular club, the final resting point of the ball depends upon golf ball aerodynamics, construction and materials, as well as environmental conditions, e.g., terrain and weather. Since flight distance and consistency are critical factors in reducing golf scores, manufacturers continually strive to make even the slightest incremental improvements in golf ball flight consistency and flight distance, e.g., one or more yards, through various aerodynamic properties and golf ball constructions. For example, early solid (gutta percha) golf balls were made with smooth outer surfaces. However, in the late nineteenth century, players observed that, as golf balls became scuffed or marred from play, the balls achieved more distance. As such, players then began to roughen the surface of new golf balls with a hammer to increase flight distance.

Manufacturers soon caught on and began molding non-smooth outer surfaces on golf balls. By the mid 1900's, almost every golf ball being made had 336 dimples arranged in an octahedral pattern. Generally, these balls had about 60 percent of their outer surface covered by dimples. Over time, improvements in ball performance were developed by utilizing different dimple patterns. In 1983, for instance, Titleist introduced the TITLEIST 384, which had 384 dimples that were arranged in an icosahedral pattern resulting in about 76 percent coverage of the ball surface. The dimpled golf balls used today travel nearly two times farther than a similar ball without dimples.

These improvements have come at great cost to manufacturers. In fact, historically manufacturers improved flight performance via iterative testing, where golf balls with numerous dimple patterns and dimple profiles are produced and tested using mechanical golfers. Flight performance is characterized in these tests by measuring the landing position of the various ball designs. For example, to determine if a particular ball design has desirable flight characteristics for a broad range of players, i.e., high and low swing speed players, manufacturers perform the mechanical golfer test with different ball launch conditions, which involves immense time and financial commitments. Furthermore, it is difficult to identify incremental performance improvements using these methods due to the statistical noise generated by environmental conditions, which necessitates large sample sizes for sufficient confidence intervals.

Another more precise method of determining specific dimple arrangements and dimple shapes, that result in an aerodynamic advantage, involves the direct measurement of aerodynamic characteristics as opposed to ball landing positions. These characteristics define the aerodynamic forces acting upon the golf ball throughout flight.

Aerodynamic forces acting on a golf ball are typically resolved into orthogonal components of lift ($F_L$) and drag ($F_D$). Lift is defined as the aerodynamic force component acting perpendicular to the flight path. It results from a difference in pressure that is created by a distortion in the air flow that results from the back spin of the ball. A boundary layer forms beginning at the stagnation point on the front of the ball. As is well known in the art, at some point generally halfway between the front and the back of a sphere, the boundary layer separates from the surface due to an adverse pressure gradient. For the case of a golf ball with backspin, the top of the ball moves in the direction of the airflow, which retards the separation of the boundary layer to a point further aft. In contrast, the bottom of the ball moves against the direction of airflow, thus advancing the separation of the boundary layer to a point further forward. Therefore, the position of separation of the boundary layer at the top of the ball is further back than the position of separation of the boundary layer at the bottom of the ball. This asymmetrical separation creates an arch in the flow pattern, requiring the air over the top of the ball to move faster and, thus, have lower pressure than the air underneath the ball.

Drag is defined as the aerodynamic force component acting parallel to the ball flight direction. As the ball travels through the air, the air surrounding the ball has different velocities and, accordingly, different pressures. The air exerts maximum pressure at the stagnation point on the front of the ball. As described above, as the air travels around the sides of the ball, at some point it separates from the surface of the ball. This creates a large turbulent flow area at the back of the ball that has low pressure, i.e., the wake. The difference between the high pressure in front of the ball and the low pressure behind the ball reduces the ball speed and acts as the primary source of drag for a golf ball.

The dimples on a golf ball are important in reducing drag and increasing lift. For example, the dimples on a golf ball create a turbulent boundary layer around the ball, i.e., the air in a thin layer adjacent to the ball flows in a turbulent manner. The turbulence energizes the boundary layer and helps it stay attached further around the ball to reduce the area of the wake. This greatly increases the pressure behind the ball and substantially reduces the drag.

Based on the role that dimples play in reducing drag on a golf ball, golf ball manufacturers continually seek dimple patterns that increase the distance traveled by a golf ball. A high degree of dimple coverage is beneficial to flight distance, but only if the dimples are of a reasonable size. Dimple coverage gained by filling spaces with tiny dimples is not very effective, since tiny dimples are not good turbulence generators.

In addition to researching dimple pattern and size, golf ball manufacturers also study the effect of dimple shape, volume, and cross-section on overall flight performance of the ball. One example is U.S. Pat. No. 5,735,757, which discusses dimples having a profile with two different radii of curvature, a relatively large radius at the bottom and a relatively small radius at the sidewalls. In most cases, however, the cross-sectional profiles of dimples in prior art golf balls are single circular arcs, although they may also be sinusoidal, parabolic, elliptical, semi-spherical, saucer-shaped, or trapezoidal, for example. One disadvantage of these shapes is that they can sharply intrude into the surface of the ball, which may cause the drag to become excessive. As a result, the ball may not make best use of momentum initially imparted thereto, resulting in an insufficient carry of the ball.

Further, the most commonly used circular arc profile is essentially a function of two parameters: diameter and depth (chordal or surface). While edge angle, which is a measure of the steepness of the dimple wall where it abuts the ball surface, is often discussed when describing this type of profile, edge angle cannot be varied independently of diameter and depth unless a more complex profile is employed, such as a dual radius profile. The cross sections of dual radius dimple profiles are generally defined by two circular arcs: the first arc defines the outer part of the dimple and the second arc defines the central part of the profile. The radii are typically larger in the center, which produces a saucer shaped dimple where the steepness of the walls (and, thus, the edge angle) may be varied independently of the dimple depth and diameter. While effective, this profile is described by a number of equations that at least require first order continuity for tangency between the arcs, as well as varying dimple diameter and depth values to achieve the desired dimple shape.

In addition to the profiles discussed above, dimple patterns have been employed in an effort to control and/or adjust the aerodynamic forces acting on a golf ball. For example, U.S. Pat. Nos. 6,213,898 and 6,290,615 disclose golf ball dimple patterns that reduce high-speed drag and increase low speed lift. It has now been discovered, however, contrary to the disclosures of these patents, that reduced high-speed drag and increased low speed lift does not necessarily result in improved flight performance. For example, excessive high-speed lift or excessive low-speed drag may result in undesirable flight performance characteristics. The prior art is silent, however, as to aerodynamic features that influence other aspects of golf ball flight, such as flight consistency, as well as enhanced aerodynamic coefficients for balls of varying size and weight.

Thus, there remains a need to optimize the aerodynamics of a golf ball to improve flight distance and consistency. Further, there is a need to develop dimple arrangements and profiles that result in longer distance and more consistent flight regardless of the swing-speed of a player, the orientation of the ball when impacted, or the physical properties of the ball being played.

SUMMARY OF THE INVENTION

The present invention concerns golf balls with improved modified aerodynamic configurations and a method for improving dimple coverage, interdigitation, and non-alignment in golf ball dimple patterns by rotating repeating area elements about pre-determined center points, with further optional steps of expanding or contracting the elemental arrangements about pre-determined center points, enlarging or reducing the sizes of dimples, and adding extra dimples to occupy land areas created by the previous steps. In one embodiment, a golf ball comprises a core and a cover having a modified aerodynamic configuration having a base aerodynamic configuration with one or more repeating geometric elements each of which comprise one or more dimples, and wherein the elements of the base aerodynamic configuration have been rotated one or more degrees about a pre-determined center point of the element resulting in the modified aerodynamic configuration.

Preferably, the base aerodynamic configuration is selected from the group consisting of icosahedron, octahedron, cube, cuboctahedron, dodecahedron, icosidodecahedron, tetrahedron and dipyramid base geometry. In another embodiment, the elements may be rotated between about 3 and about 30 degrees. The elements may be rotated causing the dimples to shift ½, 1½, 2½ or 3½ dimple diameters relative to each other. In another embodiment, the elements may be either expanded or contracted after rotation. The base aerodynamic configuration may be maximized for dimple coverage. The elements may be expanded or contacted by an arrangement factor of about 0.920 to about 1.035 and the diameters of the dimples may be enlarged or reduced by a diameter factor of about 0.910 to about 1.030. In a preferred embodiment, a plurality of additional dimples is provided in blank spaces of land areas created by the rotation of the elements. More preferably, about 5 to about 90 dimples are added to the blank spaces. In another embodiment, the dimple coverage of the modified aerodynamic configuration may be increased by at least 1 percentage point from the base aerodynamic configuration, preferably by about 1 to about 15 percentage points from the base aerodynamic configuration, and more preferably from about 3 to about 13 percentage points from the base aerodynamic configuration.

A method of making a golf ball is disclosed, the golf ball having a core and a cover and a modified aerodynamic configuration, the method comprising the steps of: selecting one or more repeating geometric elements in a base aerodynamic configuration, each element of which comprises one or more dimples; and rotating the elements one or more degrees about a pre-determined center point of that element.

BRIEF DESCRIPTION OF THE DRAWINGS

In the accompanying drawings, which form a part of the specification and are to be read in conjunction therewith, which are given by way of illustration only, and thus are not meant to limit the present invention, and in which like reference numerals are used to indicate like parts in the various views.

DETAILED DESCRIPTION OF THE PREFERRED EMBODIMENTS

Figure 1:
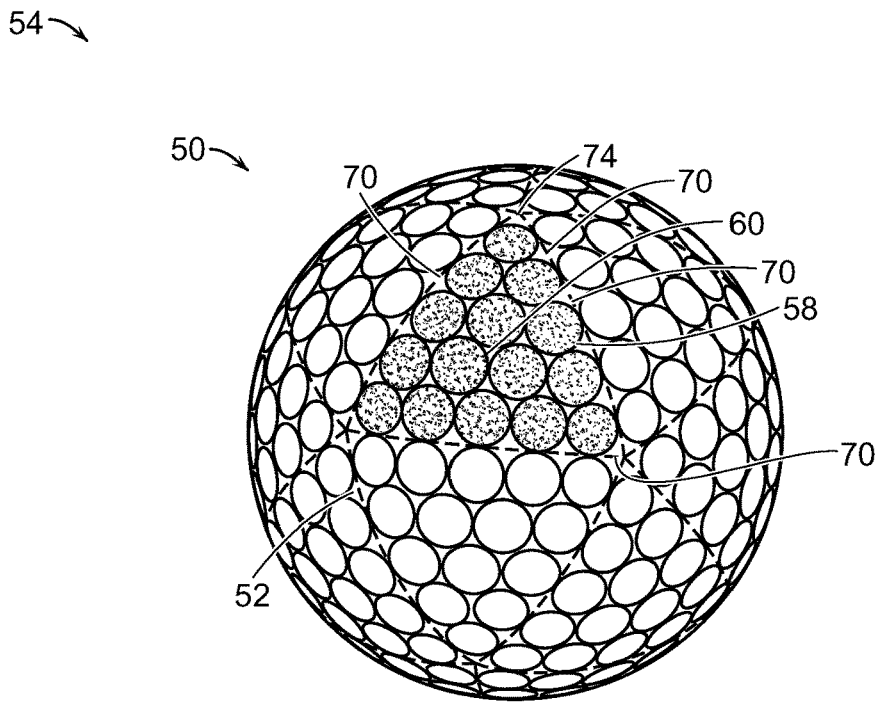
FIG. 1 is a perspective view of a prior art golf ball having triangular dimple groupings arranged thereupon in an icosahedral pattern containing 300 dimples.

Dimple patterns 50 are typically generated by dividing a surface 52 of a ball 54 into repeating area elements of one or more types, and then filling like area elements with like arrangements of dimples 58. The invention adds the additional step of rotating the area element arrangements about pre-determined center points 60, with further optional steps of expanding or contracting the area element arrangements about pre-determined center points 60, enlarging or reducing the sizes of dimples, and adding extra dimples 62 to occupy land areas 64 created by the previous steps. It will be appreciated that the steps of rotating the area element arrangements and expanding or contracting the area element arrangements may be performed about any pre-determined points, but preferably are performed about a pre-determined centroid. It will also be appreciated that the steps of rotating the area element arrangements and expanding or contracting the area element arrangements may be performed about different pre-determined points. The additional steps result in dimple patterns with novel appearance, increased interdigitation, increased dimple coverage, and/or unusual total dimple counts. Even when starting with a dimple pattern that has been well maximized for dimple coverage, dimple coverage may be increased by from about 1 to about 15 percent, more preferably by from about 3 to about 13 percent.

When creating a golf ball dimple pattern 50, it is convenient and typical to first divide the surface 52 of the ball 54 into repeating geometric area elements of one or more types. It is common to do this by radially projecting the edges of a concentric polyhedron onto the ball surface 52, the projected edges forming the boundaries 70 of the area elements. The polyhedra used are usually regular polyhedra such as a regular octahedron or a regular icosahedron, or semi-regular polyhedra such as a cuboctahedron or an icosidodecahedron, but it will be appreciated that many others may be used as well. As a result, these area elements are usually spherical triangles, spherical squares, or spherical pentagons, but it will be appreciated that other shapes may also be used. Similar types of area elements are then filled with similar arrangements of dimples 58, thus generating an overall dimple pattern 50 that covers the entire ball surface 52. In the past, it has been preferred that some dimples are positioned centered on the area element boundaries 70 (thus "sharing" them between neighboring area elements), versus positioning all of them inside of the boundaries 70. This promotes increased coverage of the ball surface 52 with dimples 58, increased interdigitation of the dimples 58, and increased non-alignment of the dimples 58 (see U.S. Pat. No. 4,960,281 the entire disclosure of which is hereby incorporated by reference herein), all of which factors are believed to improve a ball's flight performance. However, by avoiding arrangements that have all of the dimples inside of the boundaries 70, the number of available practical dimple patterns 50 becomes limited. The present invention solves this problem by providing a mechanism for improving dimple coverage, interdigitation, and non-alignment in patterns that originally have all of their dimples inside of the boundaries 70. It further provides the opportunity for new and unusual dimple counts, which can also provide performance benefits such as increased flight distance or even improved putting accuracy.

Perhaps the most common polyhedral basis for golf ball dimple patterns 50 is the regular icosahedron, which divides the ball surface 52 into 20 similar triangular area elements, each having some of its dimples 58 positioned centered along the triangle boundaries 70. Often, the layout is modified by using five similar triangles around each pole 74 and ten similar modified triangles around the equator 78. Icosahedron based layouts typically have dimple counts of 252, 332, 362, 392, or 492. FIG. 1 shows one embodiment of the present invention that has a base aerodynamic configuration of an icosahedron based layout having dimples 58 arranged entirely inside the triangle boundaries 70, with none arranged on the boundaries 70 (the dimples of one triangular area are highlighted with a crosshatch pattern). The dimple count of 300 is unusual and may provide performance benefits for specific golf ball models. Inside the triangle boundary 70 the dimple coverage and interdigitation are good; however, along the boundaries 70 they are poor due to the direct alignment of neighboring dimples across the triangle boundaries 70. Since the boundary regions form a substantial proportion of the ball's surface, this is a deficiency that makes the overall pattern less viable as a candidate for a marketable golf ball. This dimple pattern has a base dimple coverage of about 78.0%.

Figure 2:
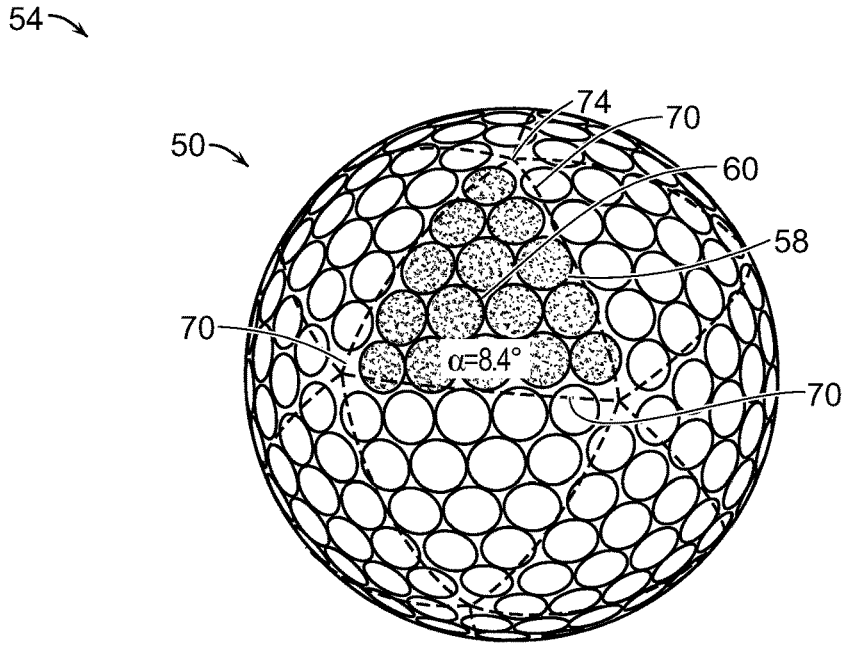
FIG. 2 is a perspective view of an embodiment of the present invention in which the triangular dimple groupings have been rotated about the triangle centroid by approximately ½ dimple diameter at the perimeter.
Figure 3:
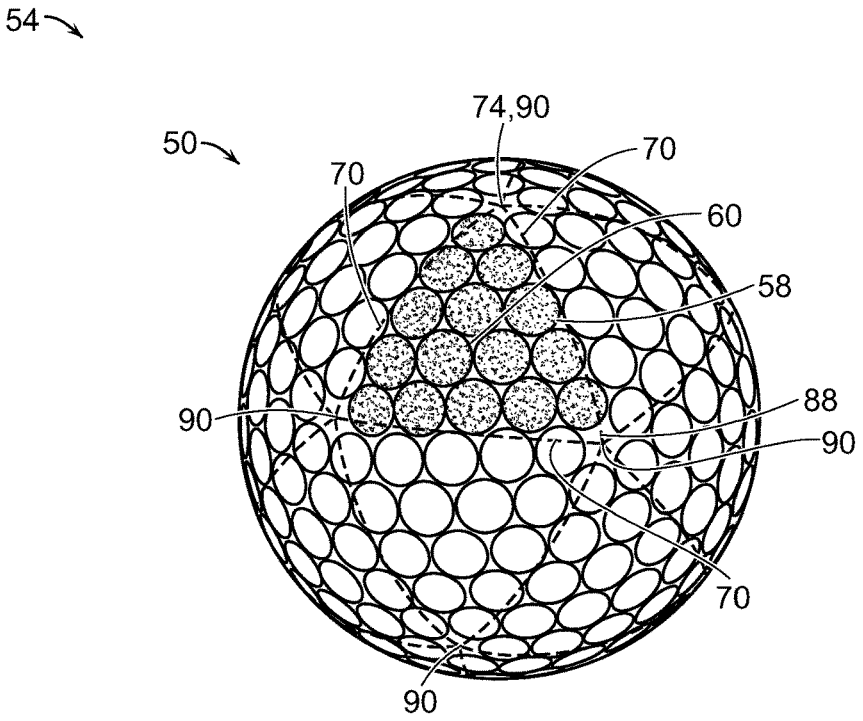
FIG. 3 is a perspective view of an embodiment of the present invention in which the triangular dimple groupings have been rotated about the triangle centroid by approximately ½ dimple diameter at the perimeter and the groupings expanded and dimples enlarged.

This situation can be improved by performing the step shown in FIG. 2, wherein the area element dimple arrangement within each triangle boundary 70 is rotated counterclockwise about its centroid 60 by an angle $\alpha$. As shown in FIG. 2, the angle $\alpha$ is about 8.4°. This moves the dimples along the triangle perimeter 70 by about ½ dimple diameter relative to their neighbors in the adjacent triangle boundaries 70, providing interdigitation and non-alignment of dimples across the boundaries, but extra space has been created between the neighboring dimples along the boundaries 70 and the dimple coverage has not been improved and remains at about 78.0%. This can be remedied by performing an optional second step as shown in FIG. 3, wherein the triangular dimple arrangement is expanded slightly about its centroid 60 by an arrangement factor of about 1.025 and each dimple 58 is enlarged slightly by a diameter factor of about 1.020. It will be appreciated that this expansion and enlargement can be by any desired amount, and in fact can be a contraction and a reduction. For example, it will be appreciated that the arrangement factor may be from about 0.8 to about 1.2, preferably about 0.920 to about 1.035, and the diameter factor may be from about 0.8 to about 1.2, preferably about 0.910 to about 1.030. It will be appreciated that the arrangement factor is the factor by which the distance of each dimple from the centroid of its area element has been changed, a value greater than 1.00 indicates expansion and a value less than 1.00 indicates contraction in the distance. Also, the diameter factor is the factor by which the diameter of a dimple in the area element has been changed, a value greater than 1.00 indicates enlargement while a value less than 1.00 indicates reduction. It is preferred but not required that the diameter of each dimple in the area element be changed by the same diameter factor. In the case of a non-circular dimple, the diameter is defined to be the diameter of a circle that circumscribes the dimple. It will also be appreciated that either or both an expansion/contraction of the area element arrangement or an enlargement/reduction of the dimples in the area element arrangement may be performed. It can now be seen that the interdigitation along the boundaries is further improved, but more importantly the dimple coverage is increased by about 3.1 percentage points in the modified aerodynamic configuration compared with the base aerodynamic configuration. Thus, dimple coverage improved from 78.0% to 81.1%.

Figure 4:
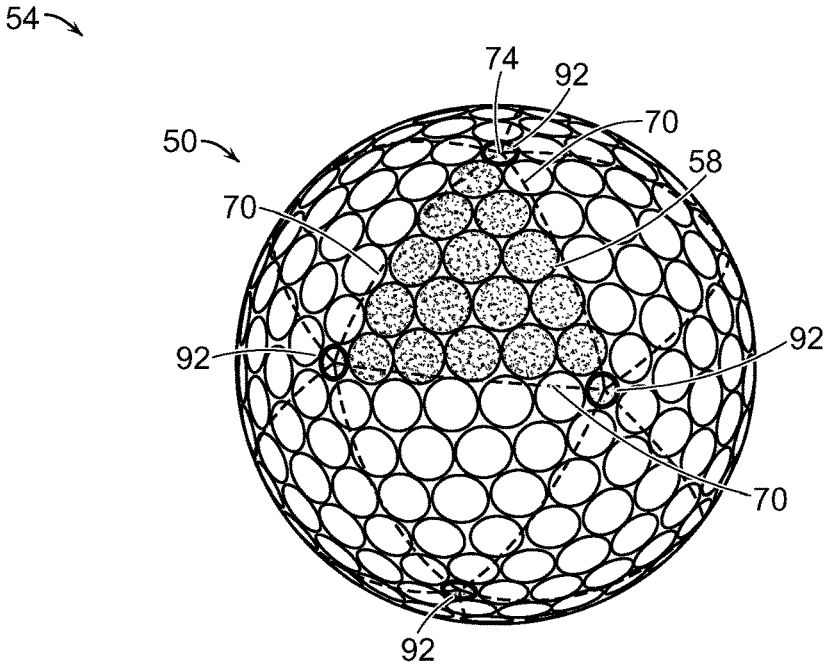
FIG. 4 is a perspective view of an embodiment of the present invention in which the triangular dimple groupings have been rotated about the triangle centroid by approximately ½ dimple diameter at the perimeter and the groupings expanded and dimples enlarged, and an additional dimple has been added at the blank space created at each triangle vertex.
Figure 5:
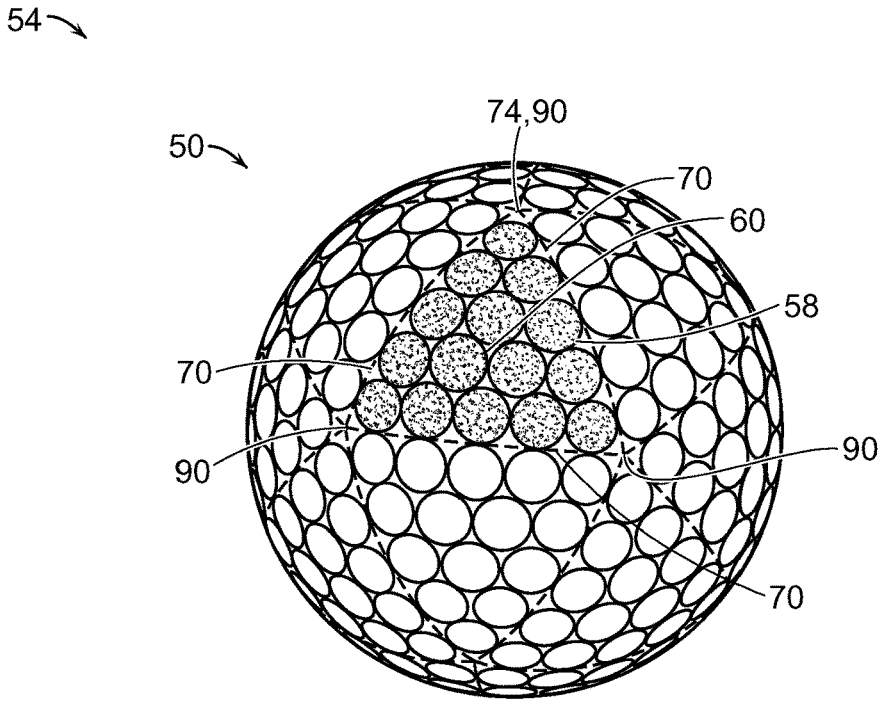
Prior Art FIG. 5
FIG. 5 is a perspective view of a prior art golf ball having triangular dimple groupings arranged thereupon in an icosahedral pattern containing 300 dimples.

A still further increase in dimple coverage may be achieved by performing another optional third step as shown in FIG. 4, wherein a blank space 88 created at each triangle vertex 90 has been filled in with a new dimple 92 (shaded in black). This increases the dimple coverage by a further 1.5 percentage points for a total improvement of 4.6 percentage points in the modified aerodynamic configuration in comparison to the base aerodynamic configuration, and increases the dimple count to 312, another unusual number. The resulting dimple coverage is about 82.6%. In this embodiment the rotations, and expansions were performed about the triangles' centroids 60, but it will be appreciated that other points of the area element arrangements may be used as desired. Furthermore, it will be appreciated that although the rotations were performed in a counterclockwise direction, a clockwise direction would have worked equally well. It will also be appreciated that although the rotation, expansion, and enlargement amounts were selected to maximize dimple coverage without creating dimple overlap, in some cases dimple overlap may be desirable (see U.S. Pat. No. 6,969,327 the entire disclosure of which is hereby incorporated by reference herein).

In other situations, especially those with a larger rotation angle, a contraction might be preferred over an expansion. All of these parameters can be adjusted to suit the individual circumstances. Moreover, it will be appreciated that the rotation angle may be any desired amount. For example, it may be between 3° and 30°, and preferably between 5° and 25°. In the first embodiment, the 8.4° angle α of rotation caused the dimples facing each other across the triangle boundaries 70 to shift about ½ dimple relative to each other, creating the interdigitation. However, a greater rotation could have been used to create a shift of about 1½ dimples, which would also result in interdigitation. It will be appreciated that the angle of rotation may be any desired amount, preferably from about ½ to about 3½ dimple rotation relative to each other. Moreover, the arrangement factor is from about 0.8 to about 1.2, and preferably about 0.920 to about 1.035, and the diameter factor is from about 0.8 to about 1.2, preferably about 0.910 to about 1.030. It will be appreciated that preferably the base aerodynamic configuration has been maximized for dimple coverage. This will allow for a more accurate comparison between the base aerodynamic configuration and the modified aerodynamic configuration. It will also be appreciated that any number of dimples may be added, preferably from about 5 to about 90 dimples, and more preferably from about 12 to about 72 dimples. The dimple coverage preferably increases by as much as possible, typically up to about 15 percentage points.

Figure 6:
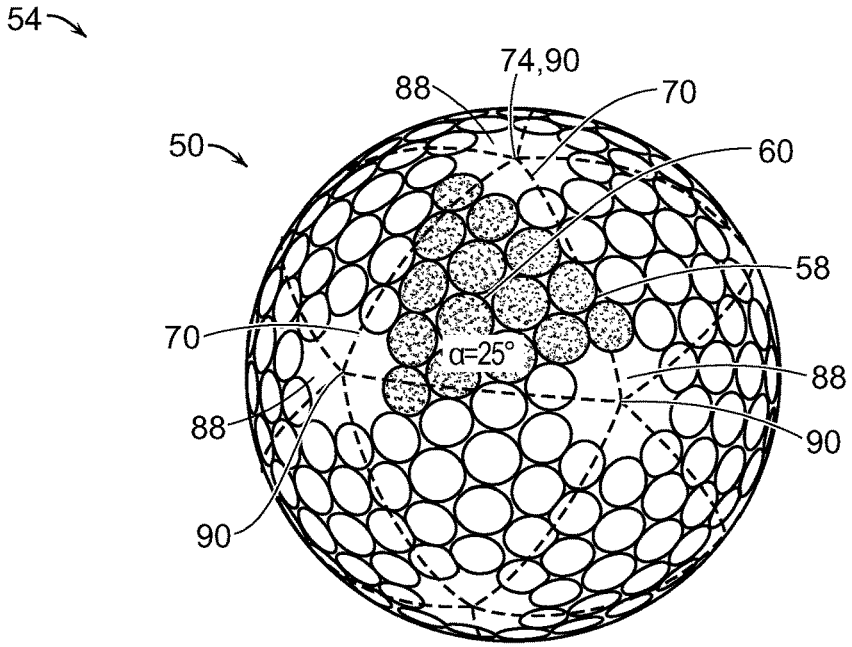
FIG. 6 is a perspective view of an embodiment of the present invention in which the triangular dimple groupings have been rotated about the triangle centroid by approximately 1½ dimple diameters at the perimeter.
Figure 7:
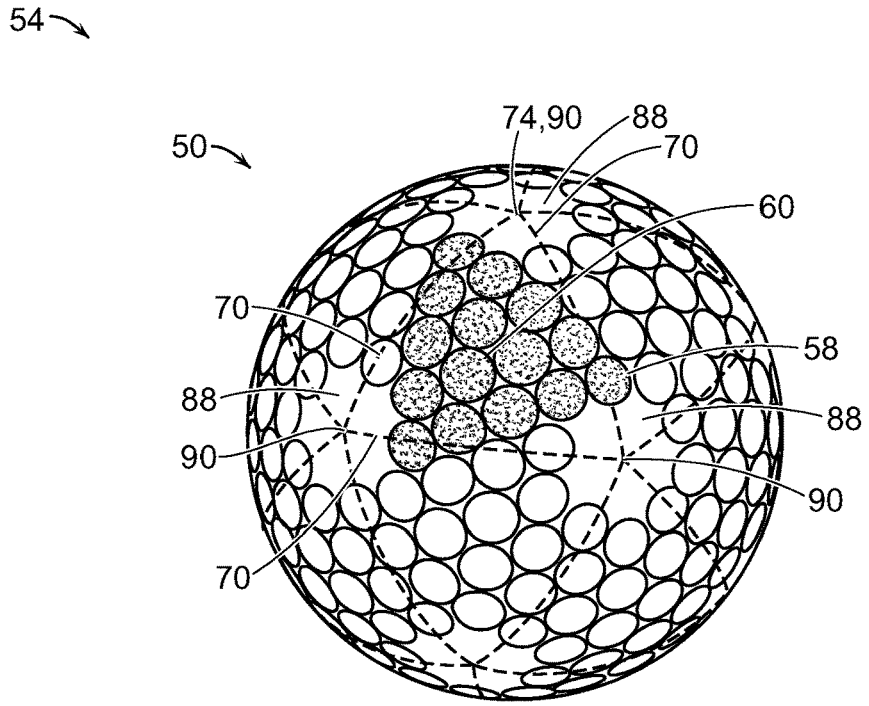
FIG. 7 is a perspective view of an embodiment of the present invention in which the triangular dimple groupings have been rotated about the triangle centroid by approximately 1½ dimple diameters at the perimeter and the groupings contracted and dimples reduced.
Figure 8:
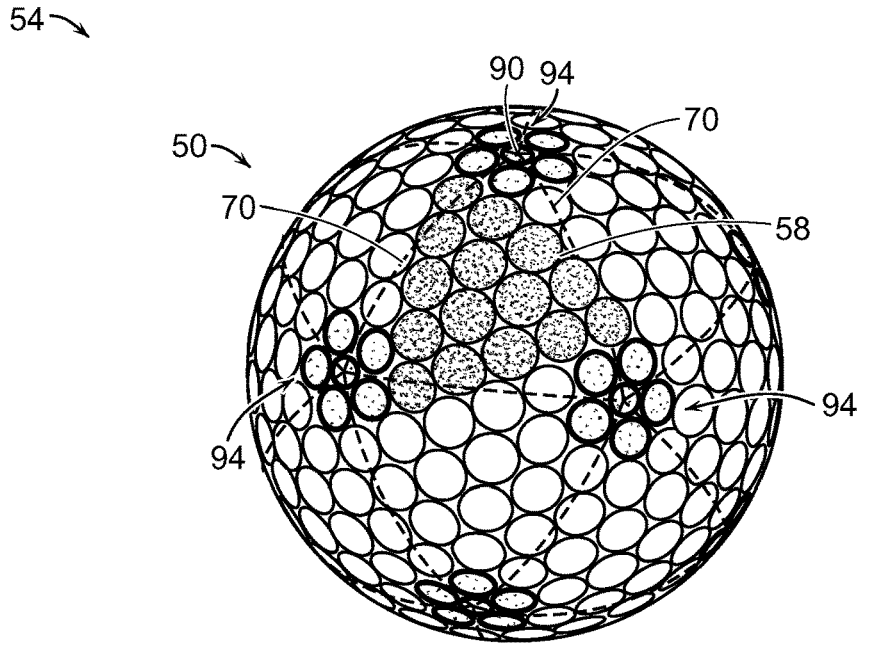
FIG. 8 is a perspective view of an embodiment of the present invention in which the triangular dimple groupings have been rotated about the triangle centroid by approximately 1½ dimple diameters at the perimeter and the groupings contracted and dimples reduced, and additional dimples have been added at the blank space created at each triangle vertex.

The greater angle of rotation is demonstrated in FIGS. 5-8, which start with the same 300 dimple icosahedron layout or base aerodynamic configuration as the first embodiment having 78.0% base dimple coverage. This time, a rotation of an angle α of about 25° is performed about the centroids 60 of the triangles, creating the 1½ dimple shift. As seen in FIG. 6, this large of a rotation causes the boundary area dimples 58 to overlap and results in a reduction of dimple coverage by 2.3 percentage points, which may be undesirable. This can be remedied by performing a slight area element arrangement contraction and a slight reduction in dimple size as shown in FIG. 7, instead of an expansion and enlargement. In FIG. 7, the arrangement contraction was by an arrangement factor of 0.950 and the reduction in dimple size was by a diameter factor of 0.940. The dimple size reduction results in a further reduction in dimple coverage to 68.9%. The larger rotation also creates larger blank space 88 at the triangle vertices 90, which can be filled in with groupings of dimples 94 instead of single dimples 92, as shown in FIG. 8. The resulting dimple count is increased substantially by 72 dimples for a total dimple count of 372. The resulting modified aerodynamic configuration has increased dimple coverage from the base aerodynamic configuration by about 2.5 percentage points, giving a dimple coverage of about 80.5% from an original dimple coverage of 78.0%.

Figure 9:
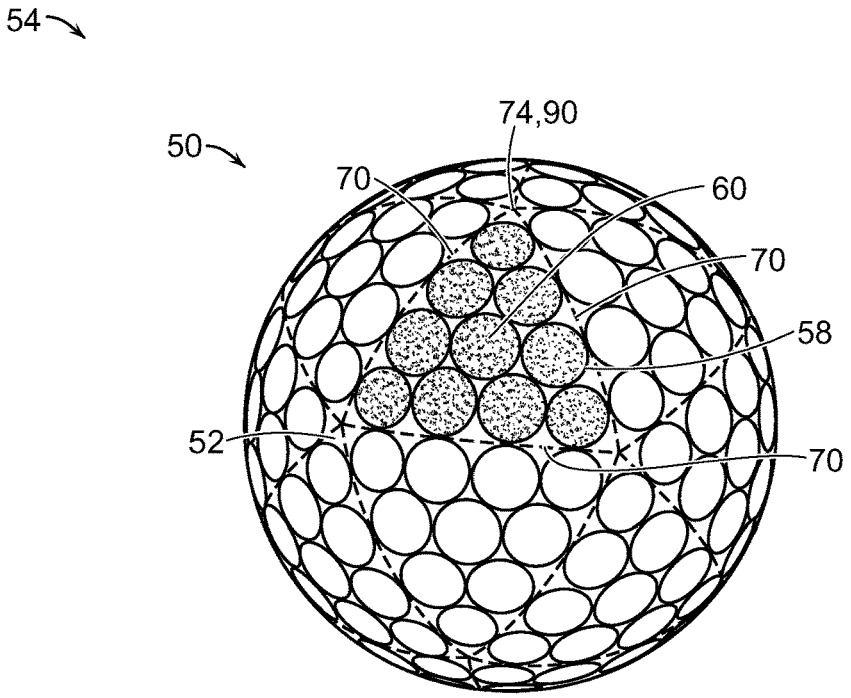
Prior Art FIG. 9
FIG. 9 is a perspective view of a prior art golf ball having triangular dimple groupings arranged thereupon in an icosahedral pattern containing 200 dimples.
Figure 10:
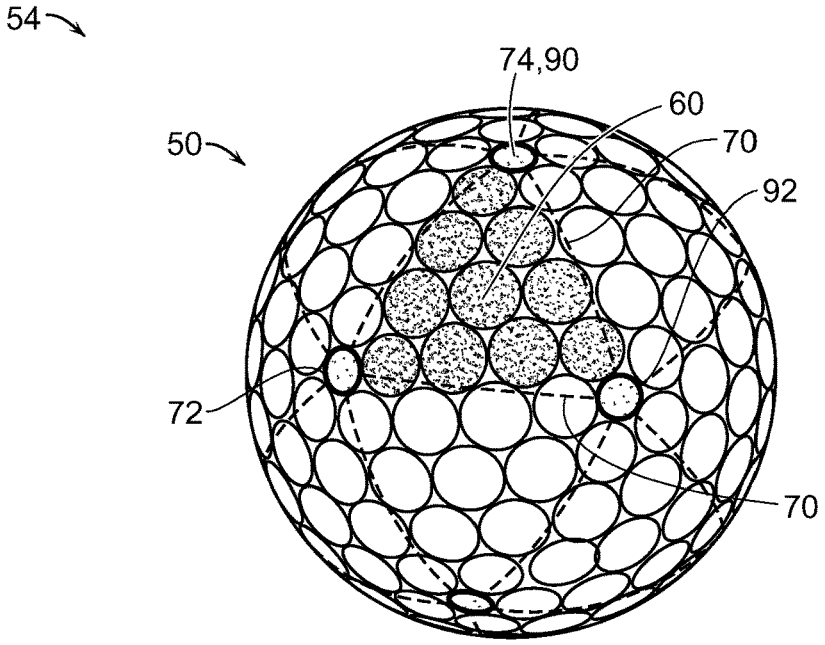
FIG. 10 is a perspective view of an embodiment of the present invention in which the triangular dimple groupings have been rotated about the triangle centroid by approximately ½ dimple diameter at the perimeter and the groupings expanded and dimples enlarged, and an additional dimple has been added at the blank space created at each triangle vertex.
Figure 11:
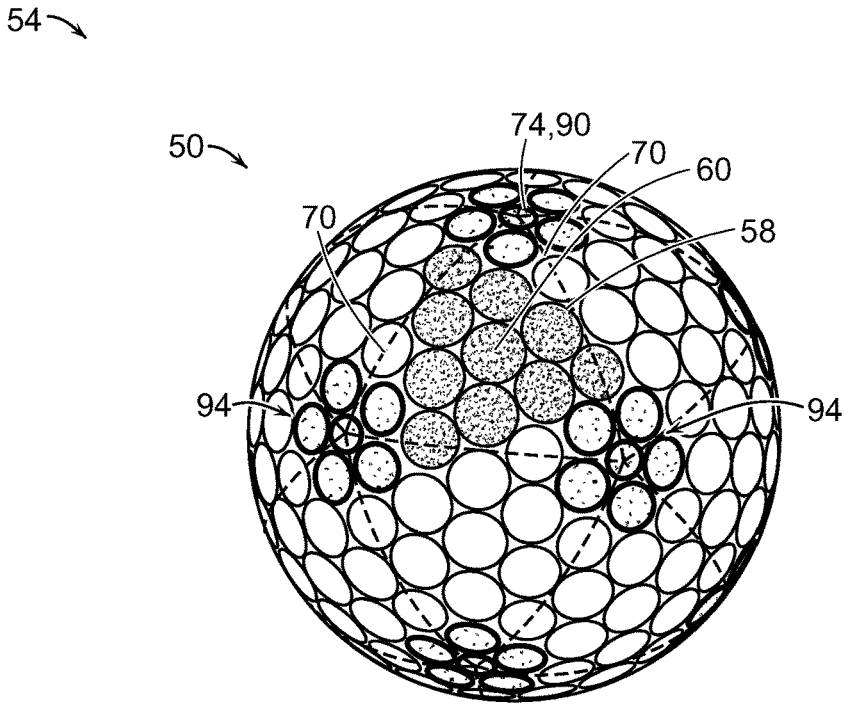
FIG. 11 is a perspective view of an embodiment of the present invention in which the triangular dimple groupings have been rotated about the triangle centroid by approximately 1½ dimple diameters at the perimeter and the groupings contracted and dimples reduced, and additional dimples have been added at the blank space created at each triangle vertex.

FIGS. 9-11 show ½ and 1½ dimple rotations performed on a 200 dimple icosahedron, resulting in modified patterns having 212 and 272 dimples. FIG. 9 shows the base 200 dimple count icosahedron pattern having 78.2% base dimple coverage. In FIG. 10, a rotation of an angle α of about 11° is performed about the centroids 60 of the triangles, creating a ½ dimple shift. Additionally, a slight area element arrangement expansion by an arrangement factor of about 1.030 and a slight enlargement in dimple size by a diameter factor of about 1.030 have been performed. Additionally, the blank spaces 88 at the vertices 90 have been filled with 12 additional dimples. This results in a modified aerodynamic configuration with dimple pattern 50 having 212 dimples and 85.4% dimple coverage, an increase of about 7.2 percentage points from the base aerodynamic configuration. As shown in FIG. 11, a rotation of an angle α of about 30° is performed about the centroids 60 of the triangles, creating a 1½ dimple shift. As discussed above, this large of a rotation causes the boundary area dimples 58 to overlap, which may be undesirable. This has been remedied by performing a slight area element arrangement contraction by an arrangement factor of about 0.920 and a slight reduction in dimple size by a diameter factor of about 0.910. Moreover, the blank spaces 88 at the triangle vertices 90 have been filled in with groupings of dimples 94 adding an additional 72 dimples. This results in a modified aerodynamic configuration with dimple pattern 50 having 272 dimples and 81.6% dimple coverage, an increase of about 3.4 percentage points from the base aerodynamic configuration.

Figure 12:
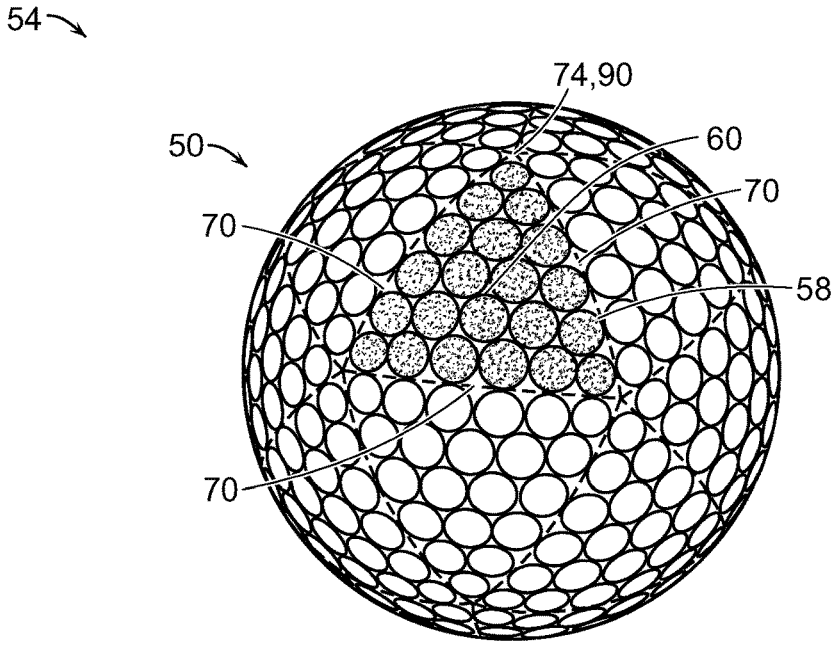
Prior Art FIG. 12
FIG. 12 is a perspective view of a prior art golf ball having triangular dimple groupings arranged thereupon in an icosahedral pattern containing 420 dimples.
Figure 13:
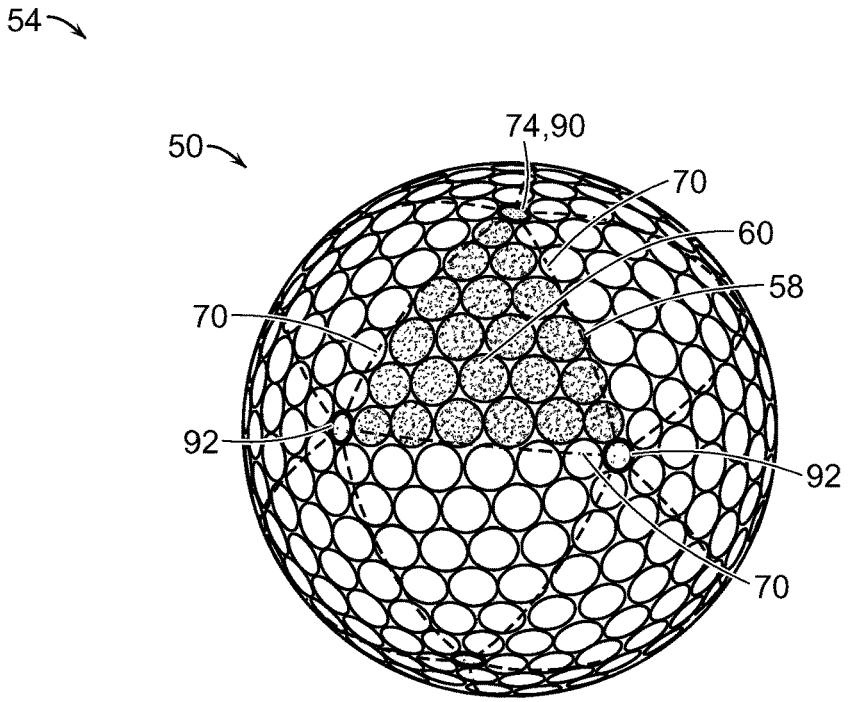
FIG. 13 is a perspective view of an embodiment of the present invention in which the triangular dimple groupings have been rotated about the triangle centroid by approximately ½ dimple diameter at the perimeter and the groupings expanded and dimples enlarged, and an additional dimple has been added at the blank space created at each triangle vertex.

FIGS. 12 and 13 show a ½ dimple rotation performed on a 420 dimple icosahedron base aerodynamic configuration, resulting in a modified dimple pattern having 432 dimples. FIG. 12 shows the base aerodynamic configuration having 77.1% dimple coverage. In FIG. 13, a rotation of an angle α of about 7.2° is performed about the centroids 60 of the triangles, creating a ½ dimple shift. Additionally, a slight area element arrangement expansion by an arrangement factor of about 1.020 and a slight enlargement in dimple size by a diameter factor of about 1.030 have been performed. The blank spaces 88 at the vertices 90 have been filled with 12 additional dimples. This results in a modified aerodynamic configuration with dimple pattern 50 having 432 dimples and 82.8% dimple coverage, an increase of about 5.8 percentage points from the base aerodynamic configuration.

Figure 14:
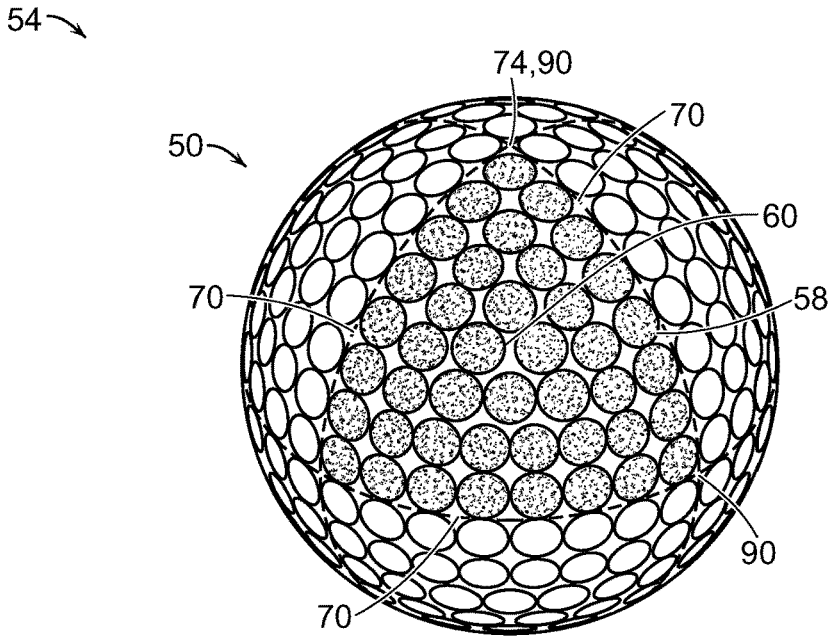
Prior Art FIG. 14
FIG. 14 is a perspective view of a prior art golf ball having triangular dimple groupings arranged thereupon in an octahedral pattern containing 336 dimples.
Figure 15:
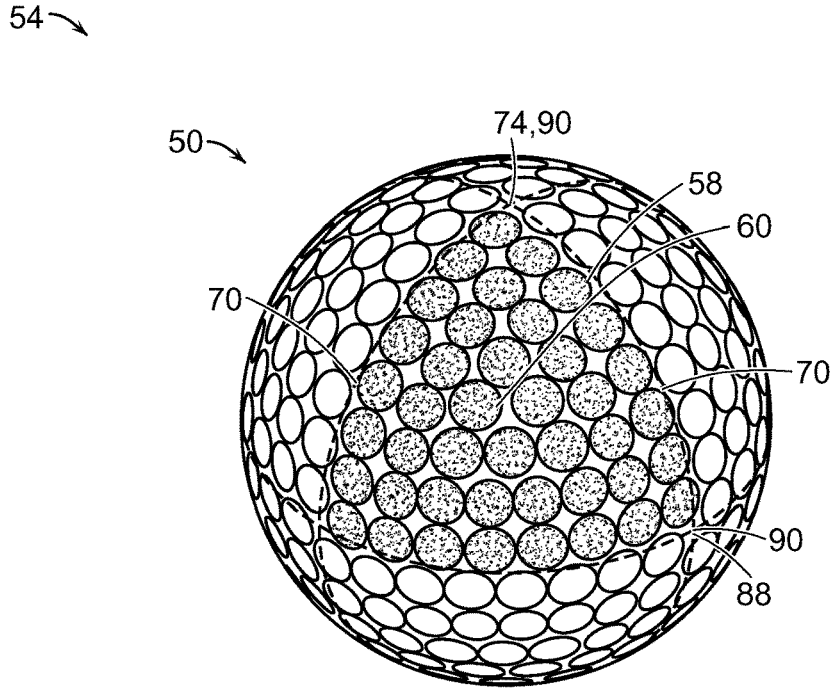
FIG. 15 is a perspective view of an embodiment of the present invention in which the triangular dimple groupings have been rotated about the triangle centroid by approximately ½ dimple diameter at the perimeter and the groupings expanded.
Figure 16:
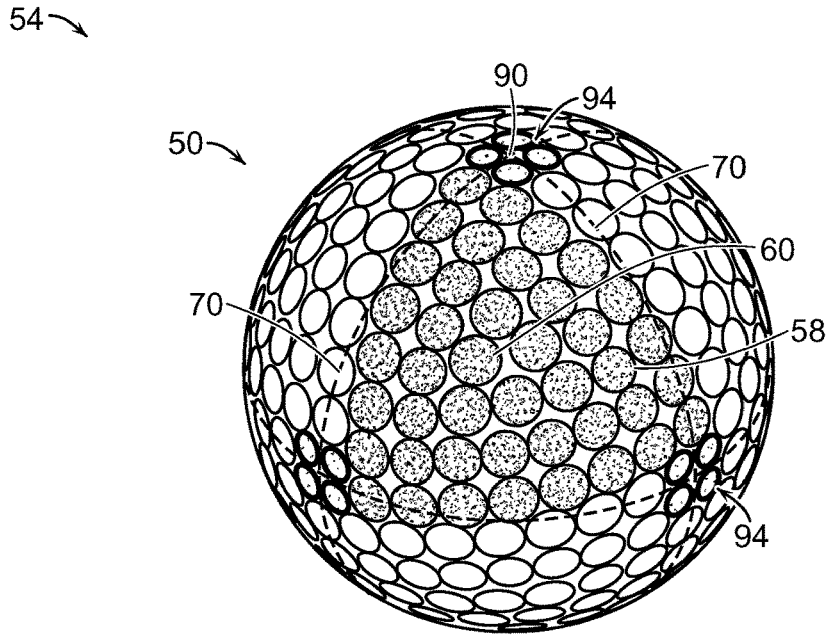
FIG. 16 is a perspective view of an embodiment of the present invention in which the triangular dimple groupings have been rotated about the triangle centroid by approximately 1½ dimple diameters at the perimeter and the groupings contracted and dimples reduced, and additional dimples have been added at the blank space created at each triangle vertex.
Figure 17:
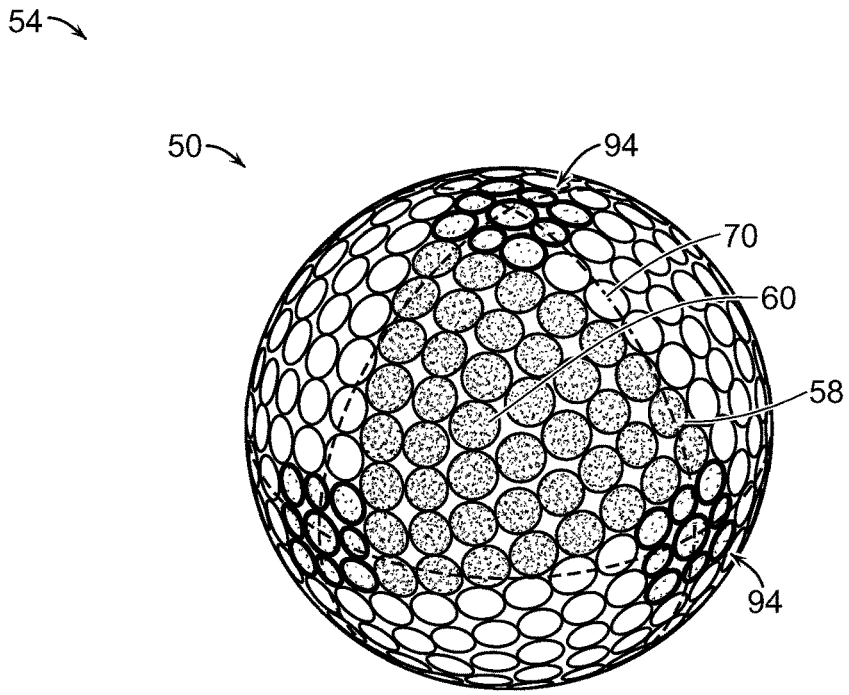
FIG. 17 is a perspective view of an embodiment of the present invention in which the triangular dimple groupings have been rotated about the triangle centroid by approximately 2½ dimple diameters at the perimeter and the groupings contracted and dimples reduced, and additional dimples have been added at the blank space created at each triangle vertex.

The invention is particularly applicable to octahedron based dimple patterns, which have historically not placed dimples along the triangle boundaries 70 because of considerations related to manufacturing parting lines. As a result, prior art octahedron patterns such as the classic "Atti" 336 pattern have suffered from poor dimple coverage, poor interdigitation, and poor non-alignment. FIGS. 14-17 show the invention applied to the 336 octahedron with the rotations creating ½, 1½, and 2½ dimple shift, producing counts of 336, 360, and 390 respectively, as well as increased coverage, greater interdigitation, and better non-alignment. FIG. 14 shows the base aerodynamic configuration having a 336 dimple count octahedron pattern with 73% dimple coverage. In FIG. 15, a rotation of an angle α of about 4.8° is performed about the centroid 60 of the triangles, creating a ½ dimple shift. Additionally, a slight area element arrangement expansion by an arrangement factor of about 1.010 has been performed with no increase in dimple size. This results in a modified aerodynamic configuration with dimple pattern 50 having 336 dimples and 73% dimple coverage, and increase of 0 percentage points over the base aerodynamic configuration. As shown in FIG. 16, a rotation of an angle α of about 14.8° is performed about the centroids 60 of the triangles creating a 1½ dimple shift. As discussed above, this large of a rotation causes the boundary area dimples 58 to overlap, which may be undesirable. This has been remedied by performing a slight area element arrangement contraction by an arrangement factor of about 0.990 and a slight reduction in dimple size by a diameter factor of about 0.980. Moreover, the blank spaces 88 at the triangle vertices 90 have been filled in with groupings of dimples 94 adding an additional 24 dimples. This results in a modified aerodynamic configuration with dimple pattern 50 having 360 dimples and 72.9% dimple coverage, which is a decrease of 0.1 percentage points from the base aerodynamic configuration. Referring now to FIG. 17, a rotation of an angle α of about 23.8° is performed about the centroids 60 of the triangles, creating a 2½ dimple shift. As discussed above, this large of a rotation causes the boundary area dimples 58 to overlap, which may be undesirable. This has been remedied by performing a slight area element arrangement contraction by an arrangement factor of about 0.955 and a slight reduction in dimple size by a diameter factor of about 0.950. Moreover, the blank spaces 88 at the triangle vertices 90 have been filled in with groupings of dimples 94 adding an additional 54 dimples. This results in a modified aerodynamic configuration with dimple pattern 50 having 390 dimples and 74.2% dimple coverage, which is an increase of 1.2 percentage points from the base dimple configuration.

Figure 18:
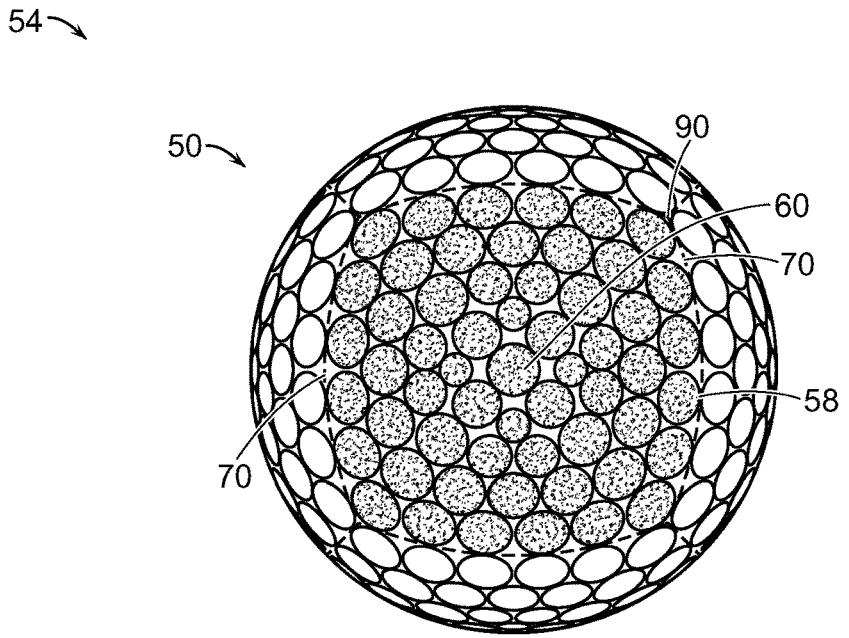
Prior Art FIG. 18
FIG. 18 is a perspective view of a prior art golf ball having square dimple groupings arranged thereupon in a cubic pattern containing 342 dimples.
Figure 19:
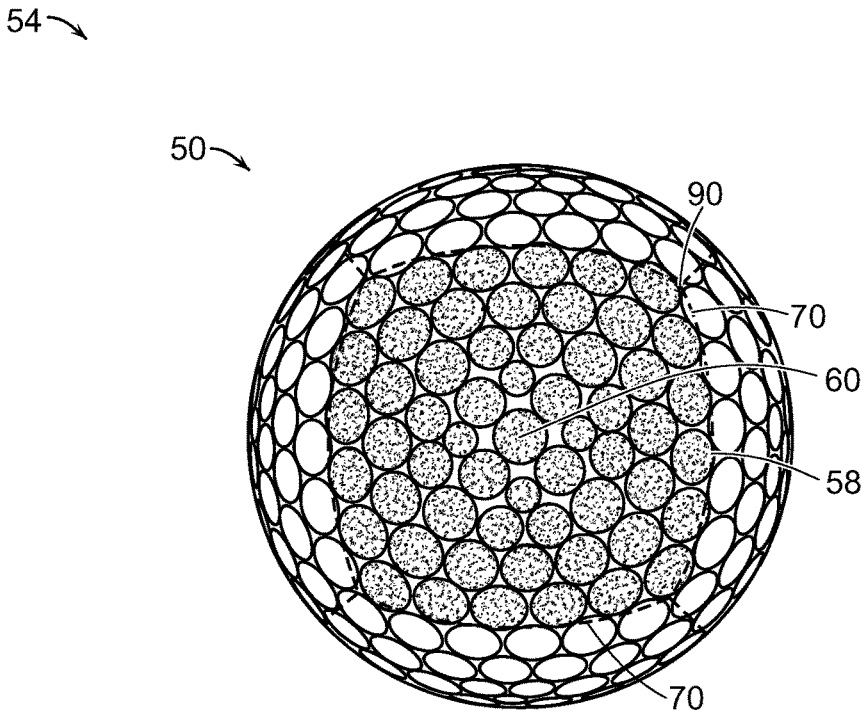
FIG. 19 is a perspective view of an embodiment of the present invention in which the square dimple groupings have been rotated about the square centroid by approximately ½ dimple diameter at the perimeter and the groupings expanded and dimples enlarged.
Figure 20:
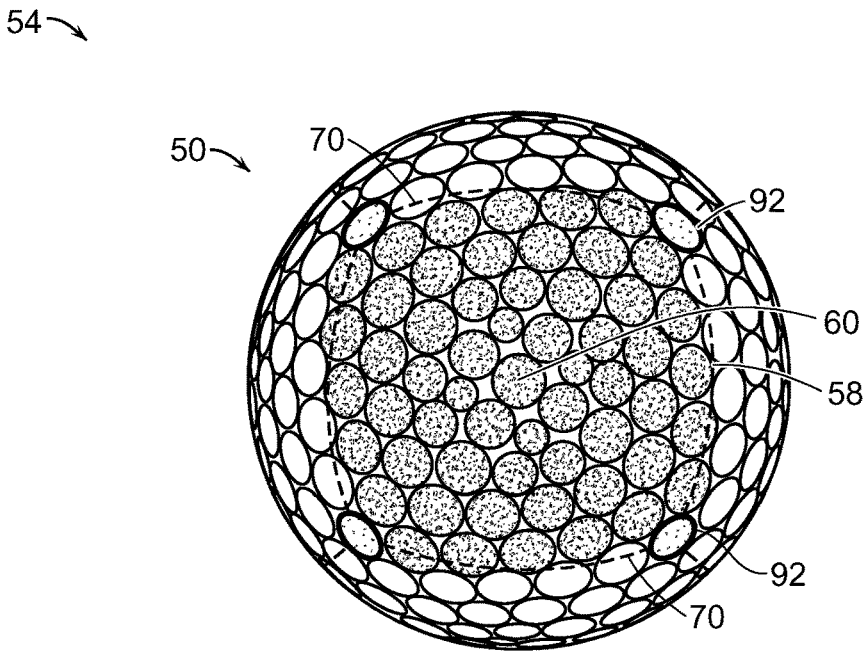
FIG. 20 is a perspective view of an embodiment of the present invention in which the square dimple groupings have been rotated about the square centroid by approximately 1½ dimple diameters at the perimeter and the groupings expanded and dimples enlarged, and an additional dimple has been added at the blank space created at each square vertex.
Figure 21:
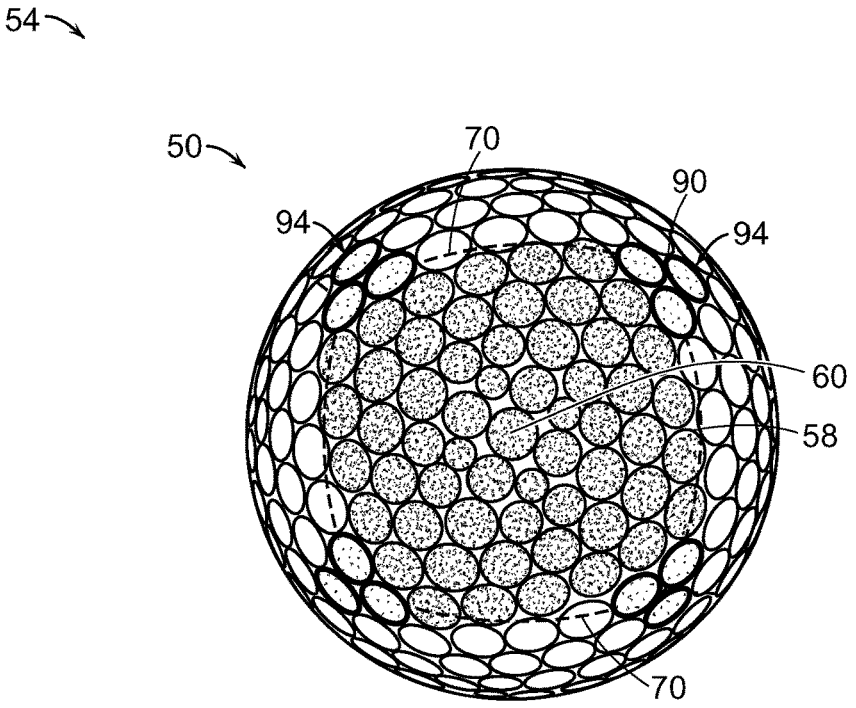
FIG. 21 is a perspective view of an embodiment of the present invention in which the square dimple groupings have been rotated about the square centroid by approximately 2½ dimple diameters at the perimeter and the groupings contracted and dimples reduced, and additional dimples have been added at the blank space created at each square vertex.

So far, the geometric area elements of the dimple patterns 50 have been spherical triangles, but other shapes may be used as well. For example, FIGS. 18-21 show the invention applied to a cube based pattern having 342 dimples arranged in spherical square areas 96. Rotations are performed creating a ½, 1½, and 2½ dimple shift, resulting in dimple counts of 342, 350, and 366 dimples respectively, as well as increased coverage, greater interdigitation, and better non-alignment. FIG. 18 shows the base aerodynamic configuration having a 342 dimple count cube pattern with 78.8% dimple coverage. In FIG. 19, a rotation of an angle α of about 4.5° is performed about the centroids 60 of the squares, creating a ½ dimple shift. Additionally, a slight area element arrangement expansion by an arrangement factor of about 1.020 and a slight enlargement in dimple size by a diameter factor of 1.020 have been performed. This results in a modified aerodynamic configuration with dimple pattern 50 having 342 dimples and 82% dimple coverage, which is an increase in dimple coverage of 3.2 percentage points from the base aerodynamic configuration. As shown in FIG. 20, a rotation of an angle α of about 13.4° about the centroids 60 of the squares is performed creating a 1½ dimple shift. Additionally, a slight area element arrangement expansion by an arrangement factor of about 1.004 and a slight enlargement in dimple size by a diameter factor of about 1.010 have been performed. Moreover, the blank spaces 88 at the triangle vertices 90 have been filled in with groupings of dimples 94 adding an additional 8 dimples. This results in a modified aerodynamic configuration with dimple pattern 50 having 350 dimples and 82.6% dimple coverage, which is an increase of 3.8 percentage points from the base aerodynamic configuration. Referring now to FIG. 21, a rotation of an angle α of about 22° is performed about the centroids 60 of the squares creating a 2½ dimple shift. As discussed above, this large of a rotation causes the boundary area dimples 58 to overlap, which may be undesirable. This has been remedied by performing a slight area element arrangement contraction by an arrangement factor of about 0.975 and a slight reduction in dimple size by a diameter factor of about 0.980. Moreover, the blank spaces 88 at the triangle vertices 90 have been filled in with groupings of dimples 94 adding an additional 24 dimples. This results in a modified aerodynamic configuration with dimple pattern 50 having 366 dimples and 82.2% dimple coverage, which is an increase of 3.4 percentage points from the base aerodynamic configuration.

Figure 22:
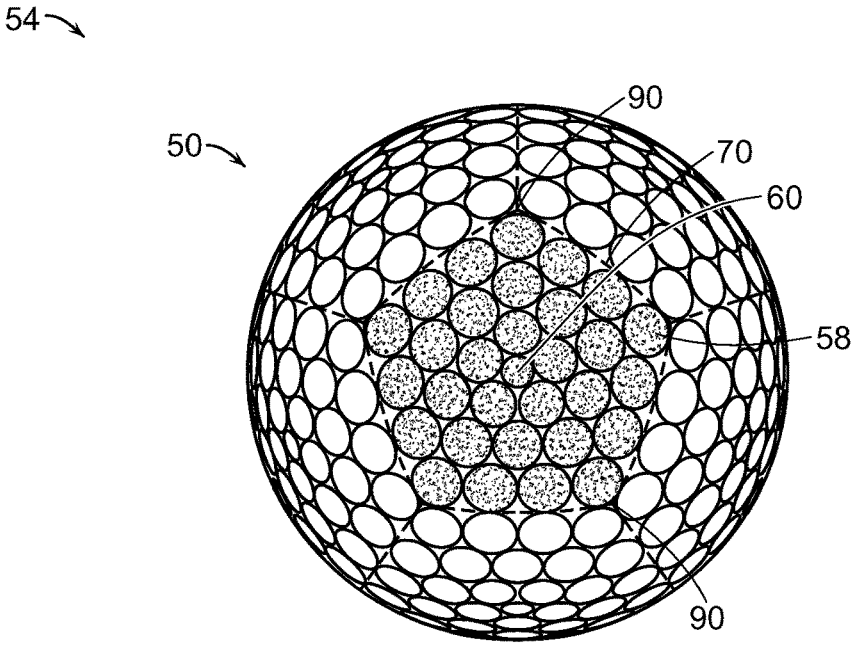
Prior Art FIG. 22
FIG. 22 is a perspective view of a prior art golf ball having pentagonal dimple groupings arranged thereupon in a dodecahedral pattern containing 372 dimples.
Figure 23:
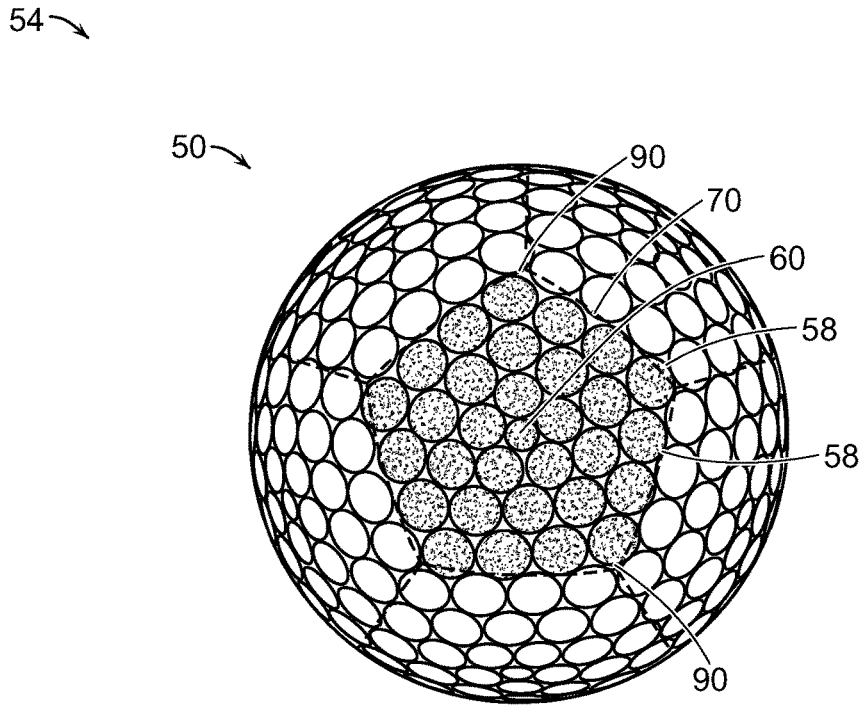
FIG. 23 is a perspective view of an embodiment of the present invention in which the pentagonal dimple groupings have been rotated about the pentagonal centroid by approximately ½ dimple diameter at the perimeter and the groupings expanded and dimples enlarged.
Figure 24:
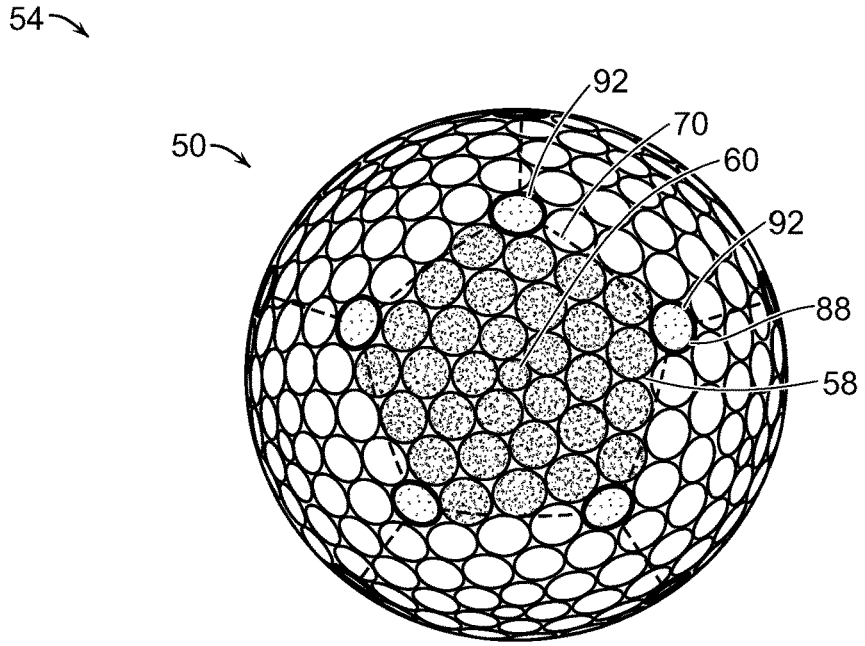
FIG. 24 is a perspective view of an embodiment of the present invention in which the pentagonal dimple groupings have been rotated about the pentagonal centroid by approximately 1½ dimple diameters at the perimeter and the groupings contracted and dimples reduced, and an additional dimple has been added at the blank space created at each pentagonal vertex.
Figure 25:
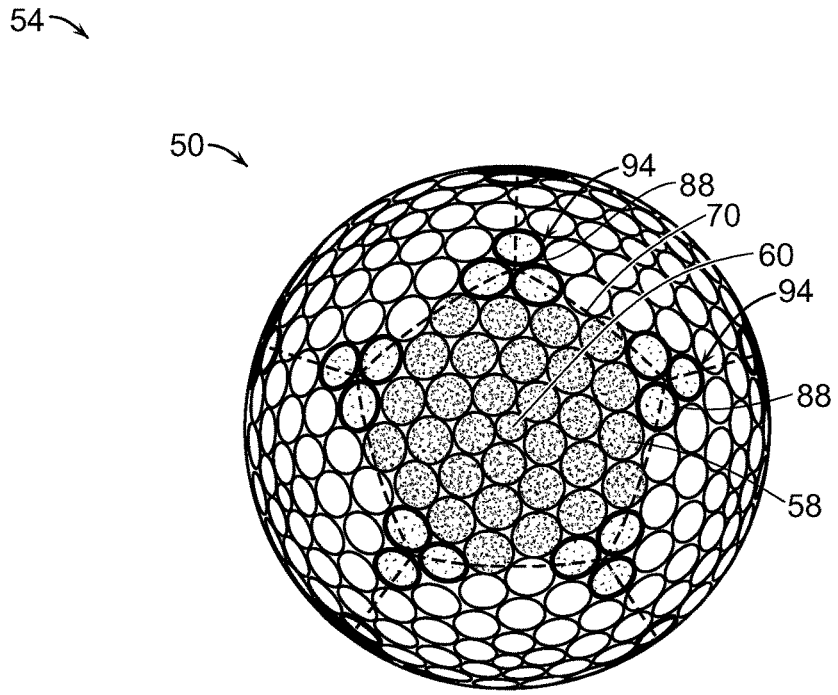
FIG. 25 is a perspective view of an embodiment of the present invention in which the pentagonal dimple groupings have been rotated about the pentagonal centroid by approximately 2½ dimple diameters at the perimeter and the groupings contracted and dimples reduced, and additional dimples have been added at the blank space created at each pentagonal vertex.

FIGS. 22-25 show the invention applied to a 372 dimple dodecahedron, which uses spherical pentagonal area elements 98. Rotations of ½, 1½, and 2½ dimples produce counts of 372, 392, and 432 dimples respectively, as well as increased coverage, greater interdigitation, and better non-alignment. FIG. 22 shows the base aerodynamic configuration having a 372 dimple count dodecahedron pattern with 81.4% dimple coverage. In FIG. 23, a rotation of an angle α of about 5.6° is performed about the centroids 60 of the pentagons, creating a ½ dimple shift. Additionally, a slight area element arrangement expansion by an arrangement factor of about 1.020 and a slight enlargement in dimple size by a diameter factor of about 1.020 have been performed. This results in a modified aerodynamic configuration with dimple pattern 50 having 372 dimples and 84.7% dimple coverage, which is an increase of 3.3 percentage points from the base aerodynamic configuration. As shown in FIG. 24, a rotation of an angle α of about 16.7° is performed about the centroids 60 of the pentagons, creating a 1½ dimple shift. As discussed above, this large of a rotation causes the boundary area dimples 58 to overlap, which may be undesirable. This has been remedied by performing a slight area element arrangement contraction by an arrangement factor of about 0.990 and a slight reduction in dimple size by a diameter factor of about 0.935. Moreover, the blank spaces 88 at the triangle vertices 90 have been filled in with groupings of dimples 94 adding an additional 20 dimples. This results in a modified aerodynamic configuration with dimple pattern 50 having 392 dimples and 84.6% dimple coverage, which is an increase of 3.2 percentage points from the base aerodynamic configuration. Referring now to FIG. 25, a rotation of an angle α of about 27° is performed about the centroids of the pentagons, creating a 2½ dimple shift. As discussed above, this large of a rotation causes the boundary area dimples 58 to overlap, which may be undesirable. This has been remedied by performing a slight area element arrangement contraction by an arrangement factor of about 0.935 and a slight reduction in dimple size by a diameter factor of about 0.930. Moreover, the blank spaces 88 at the triangle vertices 90 have been filled in with groupings of dimples 94 adding an additional 60 dimples. This results in a modified aerodynamic configuration with dimple pattern 50 having 432 dimples and 83.2% dimple coverage, which is an increase of 1.8 percentage points from the base aerodynamic configuration.

Figure 26:
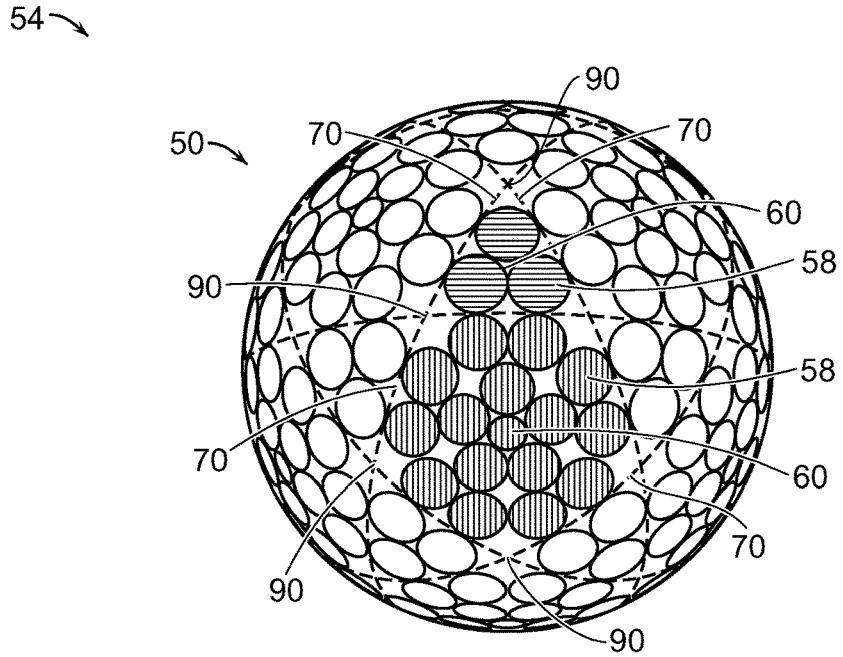
Prior Art FIG. 26
FIG. 26 is a perspective view of a prior art golf ball having pentagonal and triangular dimple groupings arranged thereupon in an icosidodecahedral pattern containing 252 dimples.
Figure 27:
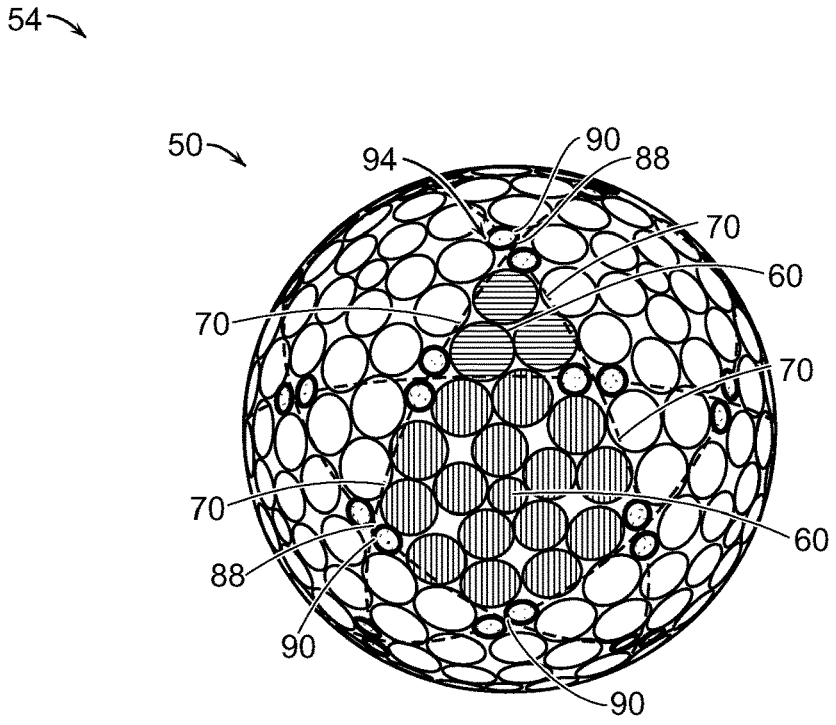
FIG. 27 is a perspective view of an embodiment of the present invention in which the pentagonal and triangular dimple groupings have been rotated about their respective centroids by approximately ½ dimple diameter at their perimeters and the groupings expanded and dimples enlarged, and an additional dimple has been added at the blank space created at each vertex.

The invention also applies to dimple patterns that employ different shaped area elements on the same ball. For example, an icosidodecahedron based pattern uses 12 spherical pentagons and 20 spherical triangles. FIG. 26 shows such a base aerodynamic configuration with a dimple pattern having 252 dimples and 70.9% dimple coverage. The dimples in one of the triangular areas are highlighted with a horizontal hatch pattern, while the dimples in one of the pentagonal areas are highlighted with a vertical hatch pattern. As shown in FIG. 27, a rotation of an angle α of about 10.7° is performed about the centroids 60 of the triangles and pentagons, creating a ½ dimple shift. Additionally, a slight area element arrangement expansion by an arrangement factor of about 1.035 and a slight enlargement in dimple size by a diameter factor of about 1.020 have been performed. Moreover, the blank spaces 88 have been filled in with groupings of dimples 94 adding an additional 60 dimples. This results in a modified aerodynamic configuration with dimple pattern 50 having 312 dimples and 77.7% dimple coverage, which is an increase of 6.9 percentage points from the base aerodynamic configuration. Thus, the invention results in a modified aerodynamic configuration having increased coverage, greater interdigitation, and better non-alignment.

Figure 28:
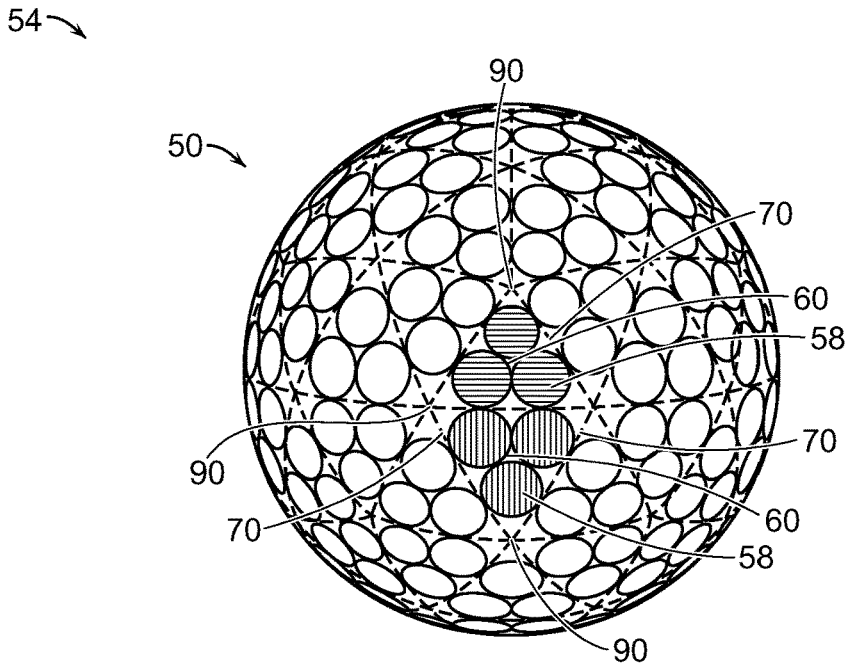
Prior Art FIG. 28
FIG. 28 is a perspective view of a prior art golf ball having two types of triangular dimple groupings arranged thereupon in a pentakis icosidodecahedral pattern containing 240 dimples.
Figure 29:
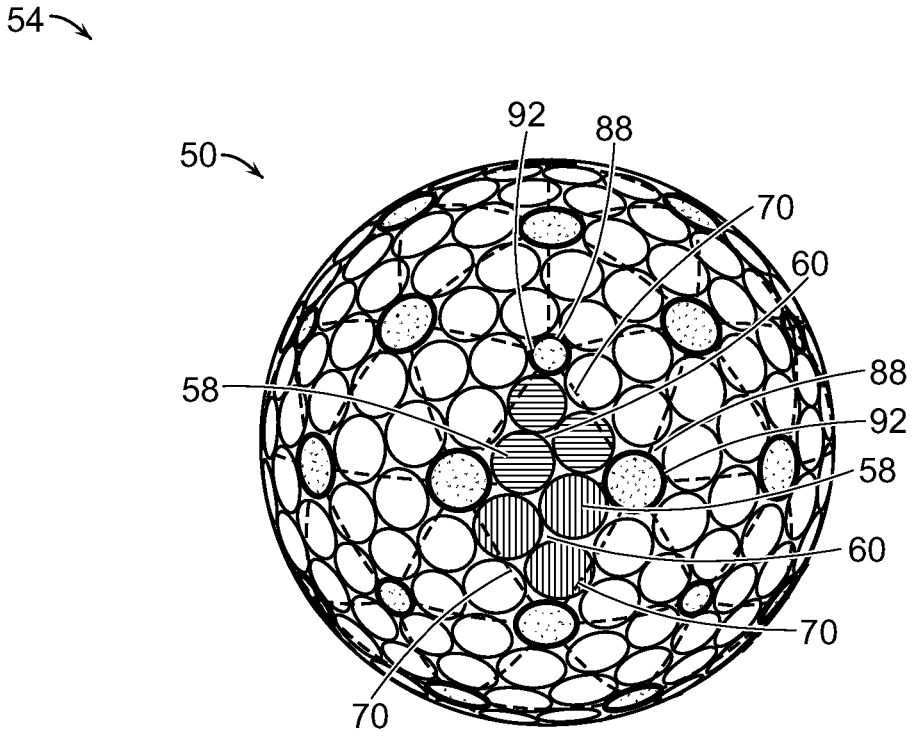
FIG. 29 is a perspective view of an embodiment of the present invention in which the two types of triangular dimple groupings have been rotated about their respective centroids by approximately ½ dimple diameter at their perimeters and the groupings expanded and dimples enlarged, and an additional dimple has been added at the blank space created at each vertex.

Finally, the invention can be used on patterns that have area elements of similar but not identical shape. For example, a pentakis icosidodecahedron pattern uses 20 spherical equilateral triangles and 60 spherical isosceles triangles. FIGS. 28 and 29 show such a base aerodynamic configuration having a dimple pattern that starts with 240 dimples and 69.6% dimple coverage. As seen in FIG. 28, the dimples in one of the isosceles triangular areas are highlighted with a horizontal hatch pattern, while the dimples in one of the equilateral triangular areas are highlighted with a vertical hatch pattern. Referring to FIG. 29, a rotation of an angle $\alpha$ of about 19° is performed about the centroids 60 of each triangle, creating a ½ dimple rotation. A slight area element arrangement expansion is then performed by an arrangement factor of about 1.030 and a slight enlargement in dimple size by a diameter factor of about 1.020. Finally, an extra 42 dimples 92 are added to fill in the empty spaces 88. This produces a modified aerodynamic configuration with dimple pattern having 282 dimples and 82.7% dimple coverage, which is an increase of about 13.2 percentage points from the base aerodynamic configuration. Thus, the invention results in a modified aerodynamic configuration having increased coverage, greater interdigitation, and better non-alignment.

The plan shapes of the dimples 58 of the present invention can be circular or non-circular, such as polygonal shaped dimples, elliptical shaped dimples, oval shaped dimples, overlapping dimples, or irregularly shapes dimples. The dimples may also be non-spherical in three dimensional shape, such as truncated cone dimples, saucer shaped dimples, parabolic dimples, elliptical dimples, faceted dimples, dual dimples, dimples-within-dimples, brambles-within-dimples, or dimples with an irregular cross-section. It will be appreciated that any dimple plan shape may be used and any three dimensional dimple shape may be used with the present invention.

While the dimple arrangements described above are based on the geometry of an icosahedron, octahedron, cube, dodecahedron, icosidodecahedron, and pentakis icosidodecahedron as is well known in the art, the present invention is not limited to use in any particular dimple pattern. The present invention applies equally well to arrangements based on other polyhedra such as cuboctahedrons, tetrahedrons or dipyramids, or to non-polyhedron based arrangement schemes that have repeating groupings of dimples. Examples of suitable dimple patterns include, but are not limited to, polyhedron-based patterns; and patterns based on multiple copies of one or more irregular domain(s) as disclosed in U.S. Pat. No. 8,029,388, the entire disclosure of which is hereby incorporated herein by reference; and particularly dimple patterns suitable for packing dimples on seamless golf balls. Non-limiting examples of suitable dimple patterns are further disclosed in U.S. Pat. Nos. 7,927,234, 7,887,439, 7,503,856, 7,258,632, 7,179,178, 6,969,327, 6,702,696, 6,699,143, 6,533,684, 6,338,684, 5,842,937, 5,562,552, 5,575,477, 5,957,787, 5,249,804, 5,060,953, 4,960,283, and 4,925,193, and U.S. Patent Application Publication Nos. 2011/0021292, 2011/0165968, and 2011/0183778, the entire disclosures of which are hereby incorporated herein by reference. Non-limiting examples of seamless golf balls and methods of producing such are further disclosed, for example, in U.S. Pat. Nos. 6,849,007 and 7,422,529, the entire disclosures of which are hereby incorporated herein by reference.

The novel dimple patterns formed by the repeating geometric areas of the present invention can be used with any type of golf ball with any playing characteristics. The present invention is not limited by any particular golf ball construction or any particular composition for forming the golf ball layers. For example, dimple pattern 50 of the present invention can be used to form dimple patterns on one-piece, two-piece (i.e., a core and a cover), multi-layer (i.e., a core of one or more layers and a cover of one or more layers), and wound golf balls, having a variety of core structures, intermediate layers, covers, and coatings. The cores of solid balls are generally formed of a polybutadiene composition. These core materials may include organosulfur or antioxidants, and may be uniform in cross-sectional hardness or may have a gradient in hardness across the cross-section. Alternatively, one of more core layers may comprise a highly neutralized polymer (HNP). In addition to one-piece cores, solid cores can also contain a number of layers, such as in a dual core golf ball. Golf ball cover layers generally comprise ionomer resins, ionomer blends, non-ionomeric thermoplastics, HNP's, grafted or non-grafted metallocene catalyzed polyolefins, thermoplastic polyurethanes, thermoset polyureas or polyurethanes, castable or RIM polyureas or polyurethanes. The golf ball cover can consist of a single layer or include a plurality of layers and, optionally, at least one intermediate layer disposed about the core.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

I claim:

1. A golf ball comprising a core and a cover having a modified aerodynamic configuration comprising a base aerodynamic configuration having one or more repeating geometric elements each of which comprise one or more dimples, wherein each of which comprise at least one dimple that is not located at the center point of the element, wherein the elements of the base aerodynamic configuration have been rotated one or more degrees about a pre-determined center point of the element resulting in the modified aerodynamic configuration, wherein the elements are expanded or contracted after rotation and the elements are expanded or contacted by an arrangement factor of about 0.920 to about 1.035.

2. The golf ball of claim 1, wherein the base aerodynamic configuration is selected from the group consisting of icosahedron, octahedron, cube, cuboctahedron, dodecahedron, icosidodecahedron, tetrahedron and dipyramid base geometry.

3. The golf ball of claim 1, wherein the elements are rotated between about 3 and about 30 degrees.

4. The golf ball of claim 1, wherein a plurality of additional dimples are provided in blank spaces of land areas created by the rotation of the elements.

5. The golf ball of claim 4 wherein about 5 to about 90 dimples are added to the blank spaces.

6. The golf ball of claim 1, wherein dimple coverage of the modified aerodynamic configuration is increased by at least 1 percentage point from the base aerodynamic configuration.

7. The golf ball of claim 6, wherein dimple coverage is increased by about 1 to about 15 percentage points from the base aerodynamic configuration.

8. The golf ball of claim 7, wherein the dimple coverage is increased by about 3 to about 13 percentage points from the base aerodynamic configuration.

9. A golf ball comprising a core and a cover having a modified aerodynamic configuration comprising a base aerodynamic configuration having one or more repeating geometric elements each of which comprise one or more dimples, wherein each of which comprise at least one dimple that is not located at the center point of the element, wherein the elements of the base aerodynamic configuration have been rotated one or more degrees about a pre-determined center point of the element resulting in the modified aerodynamic configuration, wherein the diameters of the dimples are enlarged or reduced by a diameter factor of about 0.910 to about 1.030.

* * * * *